US005644908A

United States Patent [19]

Schippers et al.

[11] Patent Number: 5,644,908

[45] Date of Patent: Jul. 8, 1997

[54] YARN FALSE TWIST CRIMPING APPARATUS

[75] Inventors: Heinz Schippers; Peter Dammann; Karl Bauer; Michael Hanisch, all of Remscheid, Germany

[73] Assignee: Barmag AG, Remscheid, Germany

[21] Appl. No.: 570,243

[22] Filed: Dec. 11, 1995

Related U.S. Application Data

[63] Continuation of Ser. No. 269,066, Jun. 30, 1994, abandoned.

[30] Foreign Application Priority Data

| | | | |
|---|---|---|---|
| Sep. 4, 1993 | [DE] | Germany | 43 29 925.3 |
| Oct. 11, 1993 | [DE] | Germany | 43 34 587.5 |
| Jan. 31, 1994 | [DE] | Germany | 44 02 832.6 |
| Feb. 11, 1994 | [DE] | Germany | 44 04 302.3 |

[51] Int. Cl.[6] ..... D01H 7/00

[52] U.S. Cl. ..... 57/290; 57/291

[58] Field of Search ..... 57/290, 1 R, 291

[56] References Cited

U.S. PATENT DOCUMENTS

| | | | |
|---|---|---|---|
| Re. 30,159 | 11/1979 | Kubler . | |
| 3,813,868 | 6/1974 | Lorenz | 57/77.4 |
| 3,946,546 | 3/1976 | Venot | 57/34 |
| 3,962,829 | 6/1976 | Schippers | 57/34 |
| 4,339,915 | 7/1982 | Dammann et al. . | |
| 4,395,872 | 8/1983 | Riedl | 57/290 X |
| 4,720,702 | 1/1988 | Martens . | |
| 4,809,494 | 3/1989 | Dammann . | |
| 4,905,468 | 3/1990 | Tanae et al. | 57/291 |
| 5,431,002 | 7/1995 | Treptow | 57/290 X |

FOREIGN PATENT DOCUMENTS

| | | |
|---|---|---|
| 4140041 | 6/1992 | Germany . |
| 4301051 | 7/1993 | Germany . |

OTHER PUBLICATIONS

ITMA '91 Textile Machine Exhibits and the lecture notes for the Apr. 1993 seminar of the Chemical Engineering Department of the Industrial Technology Research Institute, 20 pages.
Barmag AG, "FK 6 autocrimper", 18 pages.
Ernest Scragg & Sons Limited, "SDS 7", 19 pages.
ARCT, Inc., "ARCT 483", 1 page.
Zinser Textilmaschinen GmbH, "576", 8 pages.
Cognetex, "STC", 14 pages.
Murata Machinery, Ltd., "333", 15 pages.
Spinner, "160 VK–TS/A", 4 pages.
Giudici, "TG4/3", 36 pages.
Herberlein, "FZ 42/11", 12 pages.
Sotexa America, Inc., "SW 31", 1 page.
Barmag AG, "FK 6L autocrimper", 5 pages.
Berliner Textilmaschinen, "TS 500", 5 pages.
ARCT, "FTF 50", 1 page.
Ernest Scragg & Sons Limited, "SDS", 16 pages.

*Primary Examiner*—Daniel P. Stodola
*Assistant Examiner*—Tina R. Taylor
*Attorney, Agent, or Firm*—Bell, Seltzer, Park & Gibson, P.A.

[57] ABSTRACT

A yarn false twist crimping machine which comprises a processing frame which mounts the yarn processing components, a creel for mounting the yarn packages, and a take-up frame which is laterally spaced from the processing frame on the side thereof opposite the creel so as to define an operator aisle therebetween. An elongate heater is mounted to the take-up frame and an elongate cooling plate is mounted to the processing frame, and a false twist unit is mounted to the processing frame below the outlet end of the cooling plate. The yarn is guided from the creel in a generally planar arrangement across the operator aisle and to a first yarn feed system which is mounted on the take-up frame. The yarn then advances through the heater and cooling plate to the false twist unit and so as to loop back through the plane defined by the yarns being fed from the creel. Two such machines may be mounted in a mirror image relationship so as to define a service aisle which is bordered by the take-up frames of the two machines, thereby providing for the efficient servicing of the take-up devices of the two machines.

33 Claims, 8 Drawing Sheets

YARN FALSE TWIST CRIMPING APPARATUS

This application is a continuation of application Ser. No. 08/269,066, filed Jun. 30, 1994, now abandoned.

BACKGROUND OF THE INVENTION

This invention relates to a false twist crimping apparatus for crimping a plurality of thermoplastic yarns, and which is composed of several frame parts. An apparatus of this type is disclosed in DE-PS 25 30 125, and corresponding U.S. Pat. No. RE 30,159.

The false twist apparatus of the type disclosed in the above referenced patent is commonly used today. Along with the automation of the package doff, it is also known to construct the take-up device of the false twist apparatus for operation on both sides. This is disclosed in DE-47 40 041.

It is accordingly an object of the present invention to construct a false twist crimping apparatus wherein the take-up devices can be operated on both sides, without obstructing the handling of the yarn, and which may be still done by operators as in the past, such as by employing robots which are responsible for the service of the take-up devices, in particular the removal of full yarn packages and/or the supply of empty tubes.

It is also an object of the present invention to provide a false twist crimping apparatus which provides for a pair of machines which are arranged in a mirror image relationship so as to define common aisles for furnishing supply yarn packages to the creels or for removing the textured yarn packages.

SUMMARY OF THE INVENTION

The above and other objects and advantages of the present invention are achieved in the embodiments illustrated herein by the provision of a yarn false twist crimping apparatus which comprises a processing frame, a creel for supporting at least one yarn package and positioned adjacent said processing frame, and a take-up frame laterally spaced from the processing frame so as to define an operator aisle therebetween, and so as to also define a service aisle on the side of the take-up frame opposite the processing frame. False twist imparting means is provided for imparting false twist to an advancing yarn and comprising a first yarn feed system, an elongate first heater, an elongate cooling plate, a false twist unit, a second yarn feed system, and a yarn take-up device. Also, the first yarn feed system and the first heater are mounted on said take-up frame, the cooling plate, the false twist unit, and the second yarn feed system are mounted on the processing frame. The take-up device is positioned so as to be serviceable both from the operator aisle and from the service aisle.

The apparatus of the present invention can easily be enlarged to form a double machine. To this end, two machine halves are provided, with each half comprising the apparatus as described above. The two halves are arranged in mirror symmetry to a vertical plane, which extends along the take-up frame in the service aisle designated for the removal of the packages, and which is adequately spaced apart from the take-up frames of the two machine halves, so as to permit the passage and possibly the operation of a doffer. A further advantage of this arrangement, is that it permits different yarn paths or threadlines without changing the basic structure of the apparatus or double machine, these threadlines enabling a space-saving positioning of the machine components.

The false twist crimping apparatus permits each yarn to be manually threaded, which advances freely, in the feed systems and other treatment devices. It is advantageous, however, to guide each yarn from the creel through its own tube to the first yarn feed system associated therewith. On the one hand, these tubes serve to protect the yarn, and they permit the yarn to be threaded by means of a suction gun. It is easy to guide the yarn through the machine by holding the suction gun against the end of the tubular passageway or yarn guide tube located at the first yarn feed system and the yarn against the other end, which is located in the creel as closely as possible to the feed yarn package. This avoids having the operator or the yarn come into contact with machine components when threading the yarn.

A further advantage of the machine construction of the present invention is that the threading operation becomes independent of the removal of the full yarn package. This advantage results from the fact that an aisle extends on both sides of the take-up frame. From the one aisle extending between the processing frame and the take-up frame, the yarn is threaded to the take-up devices, and the respective empty tubes are supplied to the take-up device. From the other side of the take-up device, the full packages are removed. In this manner, it is accomplished that the operation is not obstructed by the transportation of the packages. This also allows the package transportation to be automated in a manner independent of the operation. On the other hand, the yarn path is selected such that the operator is able to overview the entire yarn path in all feed systems and treatment devices.

An advantage of the embodiments as shown in the drawings is that the operator aisle is free for operation by a human being, with the individual operating elements being each located on the operating surface, i.e., when viewed in the direction of operation, and none of the operating elements are successively arranged, which would considerably affect the operability. Particularly important for the good operability is that the yarn path is free and open.

With the present invention, the threadline advancing from the creel crosses the yarn path in the false twisting zone. This allows the operator to observe and handle also the yarn advancing to the first feed system essentially up to its feed package. Consequently, this yarn path does not absolutely require a tubular passageway. When a tubular passageway is useful, without however adversely affecting the accessibility and overview of the machine, a threadline may be advantageously employed wherein the yarn advances from the creel directly to the first yarn feed system, and either above, below, or through the processing frame.

Primarily when processing fine yarns having a low denier, it is desirable that the first feed system exert the lowest possible tensile forces. For this reason, it is necessary that in many applications significant deflections be avoided. This requirement is provided by constructing the apparatus as a two part machine as described above. A feature of this embodiment is that the creels of the one machine half are used to store the feed packages for the yarns which are processed on the other machine half. When in this embodiment the tubular passageways or yarn guide tubes extend substantially along the horizontal plane of the first feed system, or a plane extending obliquely downward to the feed system, essentially only one deflection of 90° will result between the supply yarn package and the first feed system. It is also possible to have each yarn enter directly into its associated first feed system.

However, when the first feed system is located such as to be not above, or not substantially above the head of the operator, the tubular passageway of this embodiment may hinder the operator. In particular, it will obstruct the view to the heater and the cooling plate, possibly even to the false twist unit. In such an instance, the yarn guide system may be designed to advance the yarn first in a vertical direction from its creel, then horizontally, and then in a downwardly inclined direction to the first yarn feed system. Thus, the yarn is guided above the thermal treatment zone.

BRIEF DESCRIPTION OF THE DRAWINGS

Some of the objects and advantages of the present invention having been stated, others will appear when the description proceeds, when taken in conjunction with the accompanying drawings, in which.

DETAILED DESCRIPTION OF PREFERRED EMBODIMENT

Figure 1:
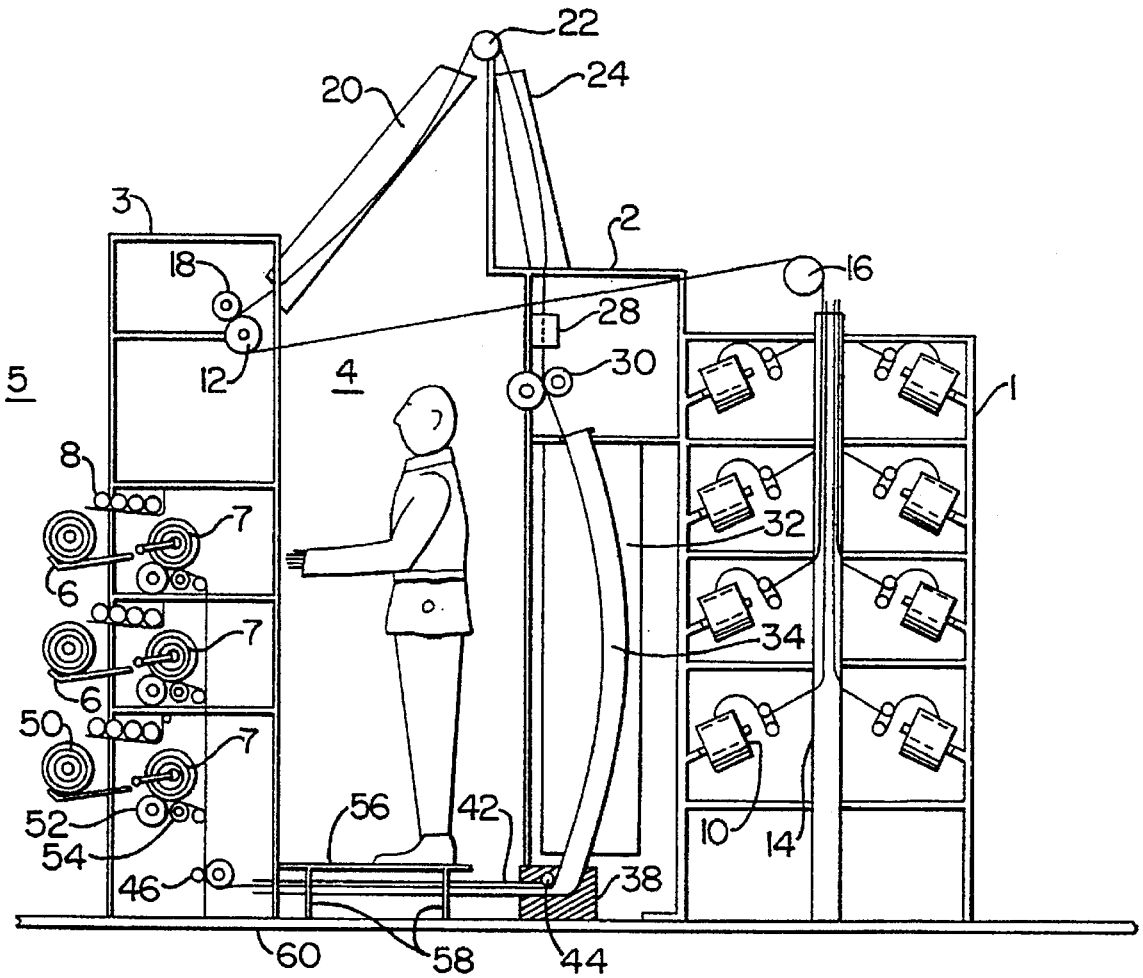
FIGS. 1 and 1A are schematic views of false twist crimping apparatus which embodies the present invention.

False twist crimping apparatus as shown in FIGS. 2–5, 7, and 8 comprise two machine halves which are constructed in entirely the same manner as the apparatus of FIG. 1. A complete separate description of each of these embodiments is therefore not necessary.

The following description applies to the false crimping apparatus shown in all Figures. Special characteristics in each embodiment of FIGS. 2–5, 7, 8 will be described with express reference thereto. The false twist crimping apparatus comprises a creel frame 1 (hereafter also referred to as creel), a processing frame 2, and a take-up frame 3. The creel 1 is set up closely adjacent, and in the illustrated embodiment, back to back with the processing frame.

In its longitudinal direction, which is perpendicular to the transverse plane of the drawings, the false twist crimping apparatus is provided with a plurality of side by side processing stations for processing one yarn each. The take-up devices occupy a width of three processing stations. Consequently, as will be described below in more detail, three take-up devices each are arranged, one on top of the other, so as to form a column.

Figure 2:
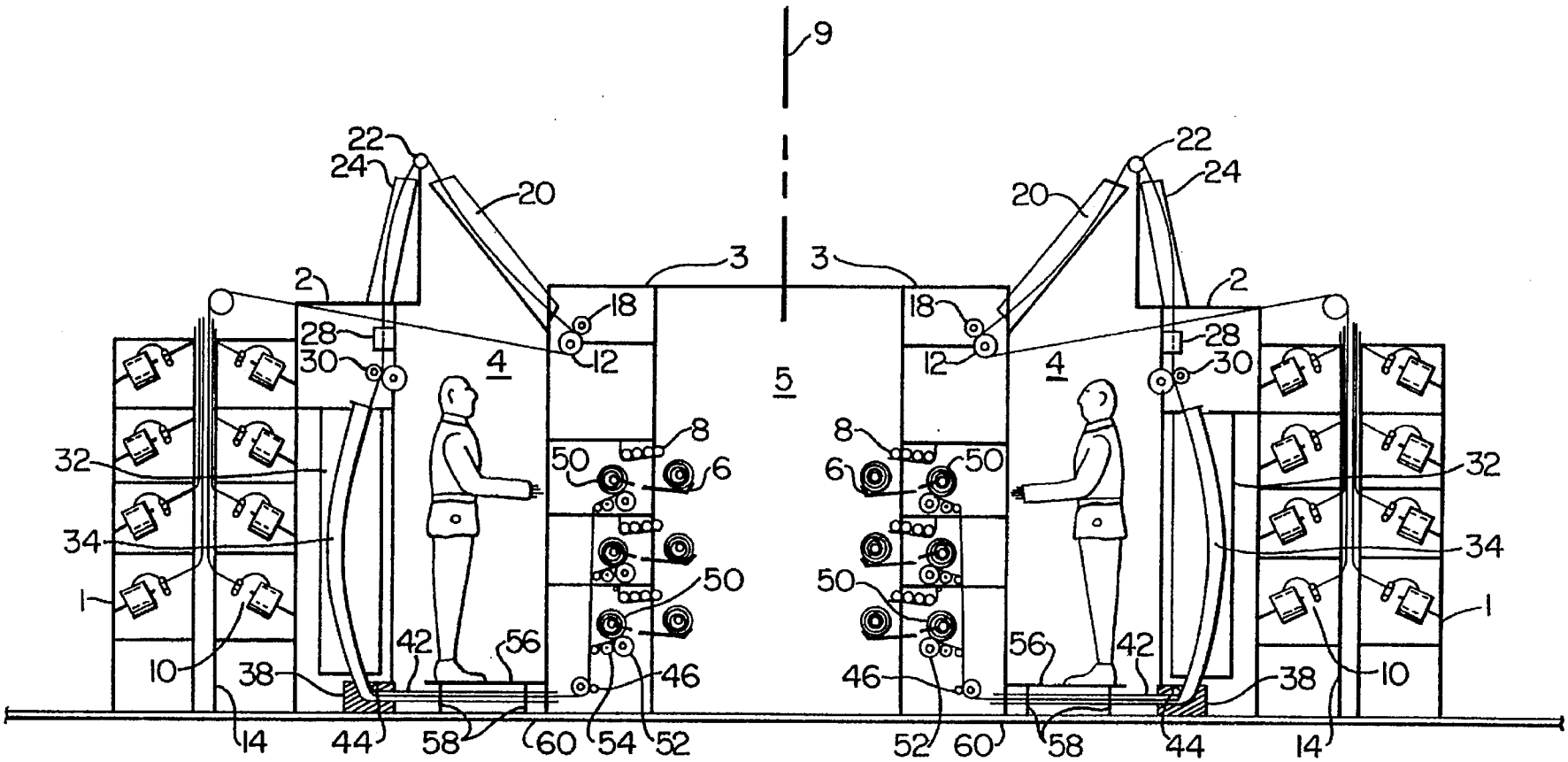
FIG. 2–5, 7 and 8 illustrate double machines having the same construction but with different threadlines.

Each processing station comprises a supply yarn package 10, on which a thermoplastic yarn 12 is wound. The yarn 12 is withdrawn overhead via a yarn guide 14 and deflection roll 26 under a certain tension by a first yarn feed system 18. In the embodiment of FIGS. 1 and 2, the yarn advances between creel 1 and first feed system 18 without a tubular passageway. It is however possible to use tubular passageways also in this instance. In the absence of tubular passageways, it is possible to also arrange on processing frame 2, for example, yarn cutters, which sever the yarn, when breakdowns occur in the course of the process between first feed system 18 and the take-up. However, it is also possible to arrange the yarn cutter on the take-up frame directly upstream of first feed system 18.

When a tubular passageway is employed, each yarn is fed into a tube at the creel. A plurality of tubes is combined to a bundle and arranged to extend along a plane above the respective creel 1 (FIGS. 1–4), or a plane in the central region of creel 1 (note FIGS. 5, 7), or a plane in the proximity of the floor (FIG. 8). The bundle of tubes then proceeds along a threadline, which will be described in more detail with reference to FIGS. 2–8, from the creel to the respective first feed system 18. This arrangement makes it necessary to fan out the threadlines in the longitudinal direction of the machine. To this end, the bundle of tubes is separated in such a manner that the openings of the tubes extend in a horizontal line, namely, that each tube opening lies in front of one of the feed systems 18, which are arranged likewise in a horizontal line extending in the longitudinal direction of the machine, as can be noted, when referring to FIG. 6.

Figure 1A:
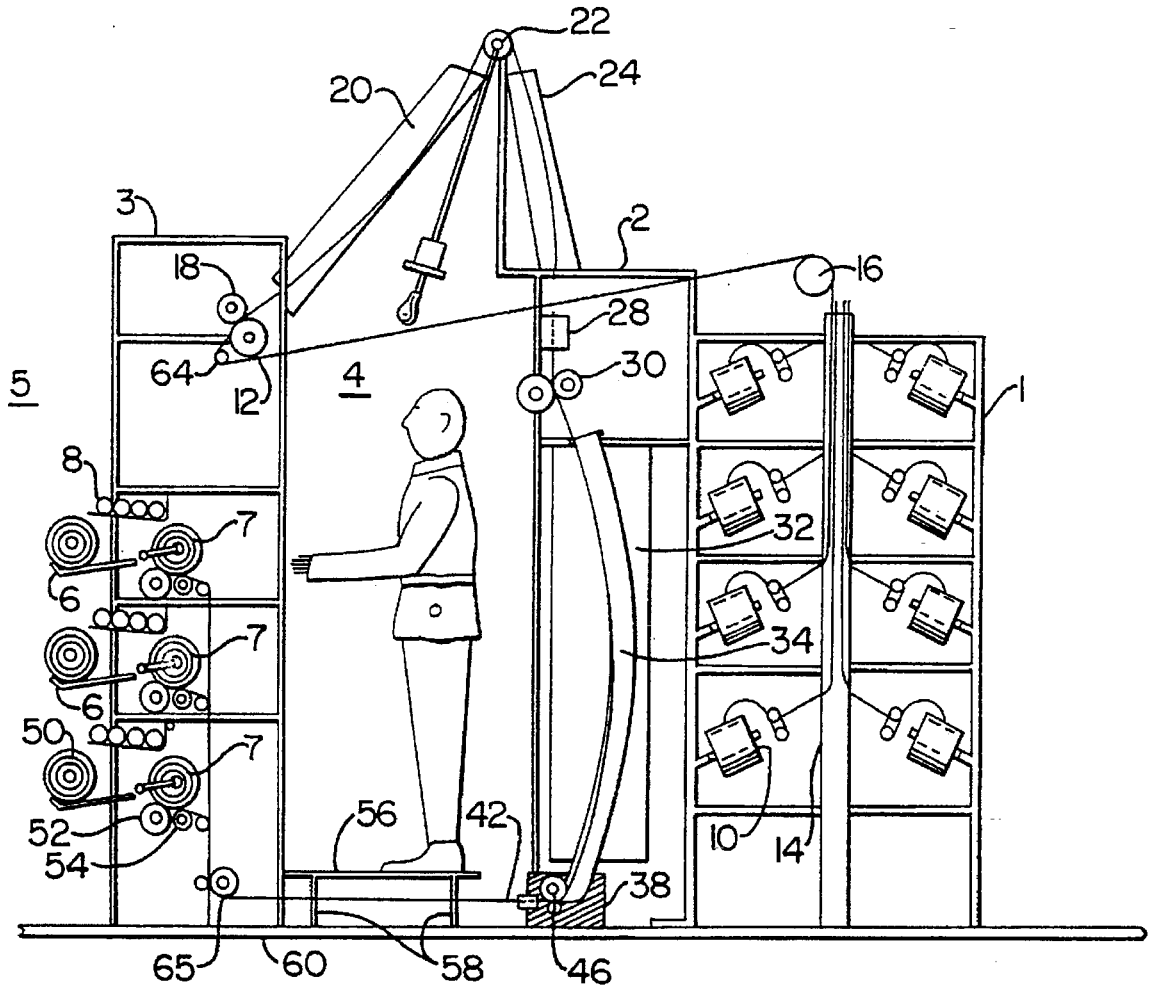
Figure 4:
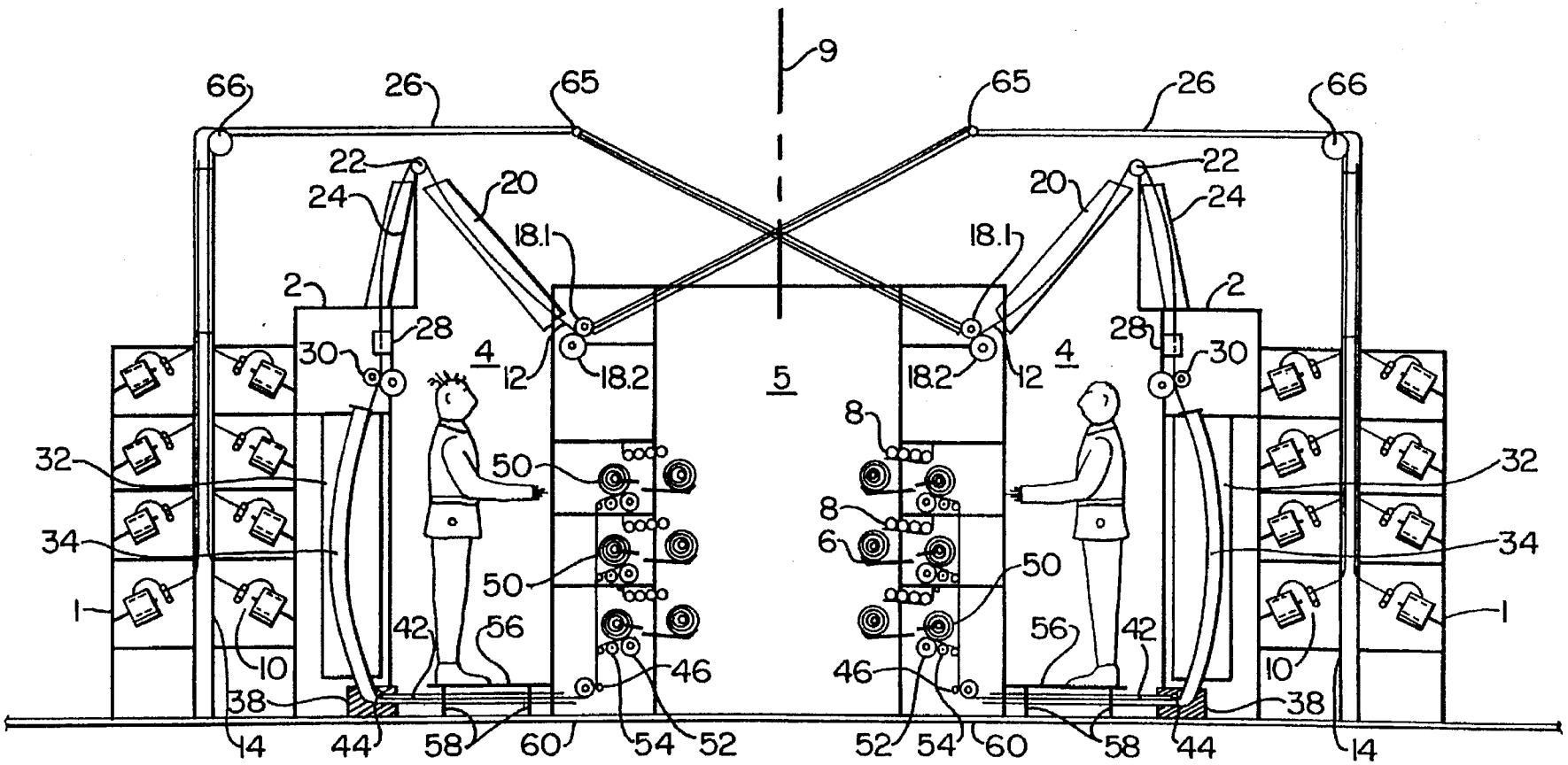

In many instances, as is shown, for example, in FIG. 4, the first feed system consists of a driven feed shaft 18.1 extending in the longitudinal direction of the machine. This feed shaft comprises a plurality of feed zones. In each feed zone, one yarn is advanced. To this end, the yarn is pressed against the feed shaft by means of an individual pressure roll 18.2 associated to each threadline. The pressure roll is adapted for radial movement for purposes of threading the yarn. It can be raised from the feed shaft, when a yarn is threaded. This means that the pressure roll must be arranged on the side of feed shaft 18.1, which faces the operator. Pressure roll 18.2 is not driven and, therefore, it is not suitable for use as a deflection roll. For this reason, it is desirable to associate a yarn guide 64 to feed system 18, as is shown in FIG. 1A. This yarn guide deflects the yarn advancing from the creel into the nip between pressure roll 18.2 and feed shaft 18.1. As can be noted, this results in a yarn deflection of more than 180° between the creel and the nip of the feed system.

In direction of the advancing yarn, downstream of feed system 18, a first, elongate heater 20 is arranged, through which the yarn advances and, in so doing, is heated to a certain temperature. The heater 20 is followed by a further yarn guide 22, which deflects the yarn and advances it to a cooling plate 24. Heater 20 and cooling plate 24 may be arranged relative to another in the shape of a roof, with 22 being arranged in the apex of the roof-shaped structure. Positioned below the cooling plate 24 is a schematically illustrated false twist unit 28. This false twist unit 28 may be constructed in accordance with DE-PS 22 13 881 or U.S. Pat. No. 4,339,915. Following false twist unit 28, an additional, second feed system 30 serves to pull yarn 12 both over heater 20 and cooling plate 24. For purposes of threading the yarn, a rod is used, which extends in a straight line between the heater and cooling plate, and on the upper end of which deflection 22 is attached. To this extent, reference may be made to DE-PS 25 30 125.

In direction of the advancing yarn, downstream of second feed system 30, a second heater is arranged, which is constructed as a curved heating tube 34 surrounded by a heating jacket 32. The heating jacket serves to heat heating tube 34 from the outside with vapor to a certain temperature. The heating tube 34 and its jacket are arranged in a generally upright orientation.

In FIGS. 1, 2–5, and 8, an equalizing tube 42 connects to heating tube 34 in seamless, i.e. airtight manner. This allows to accomplish that yarn 12 transports the atmosphere of heating tube 34 into equalizing tube 42. Arranged in the bend of a duct 38 is a yarn guide 44, which is constructed as a pin or roll with a peripheral groove. The pin or roll serves to advance yarn 12 with the slightest possible friction from heating tube 34 into equalizing tube 42. The heated air which is entrained by yarn 12 from set heater tube 34 into equalizing tube 42 results in that, despite the relatively low temperature, for example, about 160–180° C., in second heater 34, the crimp imparted to yarn 12 in false twist zone 28 is further reduced than is possible with known heaters.

Arranged at the outlet end of tube 42 is a third yarn feed system 46. Upstream or downstream thereof, a device not shown is located, which applies a spin finish (fluid) to yarn 12. The yarn is wound to a package 50 which is driven on its circumference by a friction roll 52. Arranged in front of friction roll 52 is a traversing mechanism 54, which reciprocatesyarn 12 along package 50, so as to deposit it thereon in a cross wind.

In all false twist crimping machines, which are subject matter of this invention, it is possible to provide below the second heater 34 in the place of equalizing tube 42, first, a further feed system 46 in the place of deflection 44, then an entanglement nozzle, and finally a feed system 65. This arrangement will allow to entangle the treated yarn under an adjustable yarn tension in the entanglement nozzle by directing air thereto, and to blend the filaments with one another. This method is useful in the treatment of a multifilament yarn for improving its winding properties. However, it is also possible to apply this method, so as to interlace and ply two yarns which have been produced on two different processing stations. With respect to the foregoing description, note FIG. 1A. The additional feed system 65 and the entanglement nozzle, however, may be omitted.

Located above equalizing tube 42 is a platform 56, which is supported by rails or posts 58 above floor 60, and serves as an operator aisle 4. The operator aisle 4 is formed between processing frame 2 and take-up frame 3.

While creel frame 1 has been described above, processing frame 2 comprises, arranged from top to bottom, the following machine components:

Mounted on the upper end of processing frame 2 is cooling plate 24. Arranged therebelow is false twist unit 28, and below same the second feed system 30. Mounted below the second feed system 30 is the second heater 34. Thus, the processing frame 2 is characterized in that it accommodates only such machine components which serve to treat the yarn.

Supported on take-up frame 3 in its upper region are the first feed system 18, as well as the first heater 20. Accommodated in its lower region is a spin finish applicator (not shown), as well as alternatively a deflection device, or the third feed system 46 (note FIGS. 1 and 2), or a fourth feed system 65 (FIG. 1A).

It should be expressly stated that the third feed system may be arranged either at the bottom in processing frame 2, or at the bottom in take-up frame 3. When the third feed system is located in processing frame 2 at the bottom, the equalizing tube 42 may be omitted. In this instance, the deflection 44 is arranged in take-up frame 3 in the place of the illustrated feed system 46.

The take-up frame 3 serves to accommodate the take-up and auxiliary devices. The latter include the following:

A package storage 6 serves to receive the full packages, which are removed from the respective take-up device, after a take-up device 7 has produced a full yarn package 50. To remove a full yarn package 50, the spindle carrier is rotated, and the full package is deposited on a rollway, which forms a part of package storage 6. On the rollway, the full yarn package 50 waits for its removal. For this reason, the rollway of package storage 6 is arranged on the side of take-up frame 3, which is adjacent to service aisle 5 and faces away from the operator aisle. The service aisle extends along take-up frame 3, and serves for the removal of the full packages waiting in storage 6. Furthermore associated to each take-up device 7 is a tube feed device 8, which is not described in detail. It is a tube magazine, in which several tubes are temporarily stored. After a full yarn package has been produced on the spindle carrier of a take-up device 7 and deposited on the package storage, an empty tube is fed to the spindle carrier and secured thereon, as is disclosed in detail, for example, in DE-A 41 40 041.

It should here be expressly stated, that FIGS. 2–5, 7, and 8 illustrate double machines. It is easily possible to combine the frame parts, namely, creel frame 1, processing frame 2, and take-up frame 3 to a one-sided machine, as is shown in FIGS. 1 and 1A for the threadline of FIG. 2. In each instance, double machines are formed by positioning two identical machines in mirror-symmetry to a mirror plane 9, which extends at a distance from the service side of take-up frame 3, i.e., in front of package storage 6, thereby creating in the double machine an adequately wide service aisle 5 between the two take-up frames 3.

On the other hand, even the handling of the full packages and the empty tubes out of service aisle 5 remains unobstructed by the handling of the yarn. The handling of the yarn proceeds from operator aisle 4. The handling of the packages and the handling of the yarn can therefore occur independently of one another. As a result, this machine setup is particularly suitable for automating the handling of packages including the feed of tubes. It should however be emphasized that considerable advantages for the handling of the packages by a human being also result from this setup as a result of keeping the yarn handling independent of the package handling.

The handling of the packages is facilitated in that each take-up device is associated with a package storage. Such a package storage 6 consists of a rollway, which extends perpendicularly to the vertical longitudinal plane of the machine, and which is somewhat inclined and provided with a stop at its end. Each full package is deposited on this rollway. The full package waits then for an operator or a storage device, which picks up the full package. The take-up device itself is ready for winding a new package, as soon as the full package is deposited on the rollway. Suitable storage devices are shown, for example, in DE-OS 41 40 041 and DE-OS 43 01 051.

The special advantage of the false twist crimping machine consists in that the creel for the feed yarn packages on the one hand and the package storage of the take-up are arranged on opposite sides of the machine. Therefore, when two identical machines are arranged lengthwise side by side, the full packages will face one another in the service aisle 5 formed therebetween and the feed yarn packages in the next service aisle. The service aisles between several, lengthwise juxtaposed machines alternate in serving exclusively for the removal of the full packages and the supply of empty tubes, and on the other hand exclusively for the supply of feed yarn packages and the removal of unwound, empty tubes. This distinct separation allows to simplify the flow of materials significantly.

It should be remarked at this point that it is also possible to arrange creel frame 1 on a different floor, preferably above the floor, on which the remaining frame portions are installed. In this instance, it is recommended to use a tubular passageway, which corresponds, when modified accordingly, to tubular passageway 26 of FIGS. 3–5, 7, and 8. The arrangement of different floors allows to still further reduce the width of the false twist crimping machines, be it constructed as a single machine, or as a double machine, when creel frame 1 is fully or in part arranged vertically above processing frame 2, and/or take-up frame 3, and/or operator aisle 4, and/or service aisle 5.

The following description applies to the embodiments of FIGS. 1–8:

Referring to FIGS. 1, 1A, and 2, the frame members, namely creel 1, processing frame 2, and take-up frame 3, are arranged with respect to each other, and the yarn is guided such that it describes a path in the shape of the figure nine between guide roll 16, i.e. between the creel and the take-up frame. This means that the yarns advancing from creel 1 and guide roll 16, are guided first in a horizontal or inclined plane through the processing frame (or thereabove) right to the take-up frame. During their passage in this plane they are fanned out such that each yarn is advanced to one of the feed systems 18 which are arranged one after the other in the longitudinal direction. Then, each yarn is returned in a loop, which is upward directed and encompasses the thermal treatment zone with first heater 20 and cooling plate 24, to the processing frame, and intersects here the threadline plane of the group of yarns advancing from creel 1. Each yarn is then guided vertically downward through false twist unit 28, second feed system 30, and set heater 34. There, the threadline describes a curve between yarn guide 44 and the third feed system 46 (or vice versa, the third feed system and the yarn guide), so as to cross below operator aisle 4 and advance upward to take-up frame 3, where the yarn is wound.

Figure 3:
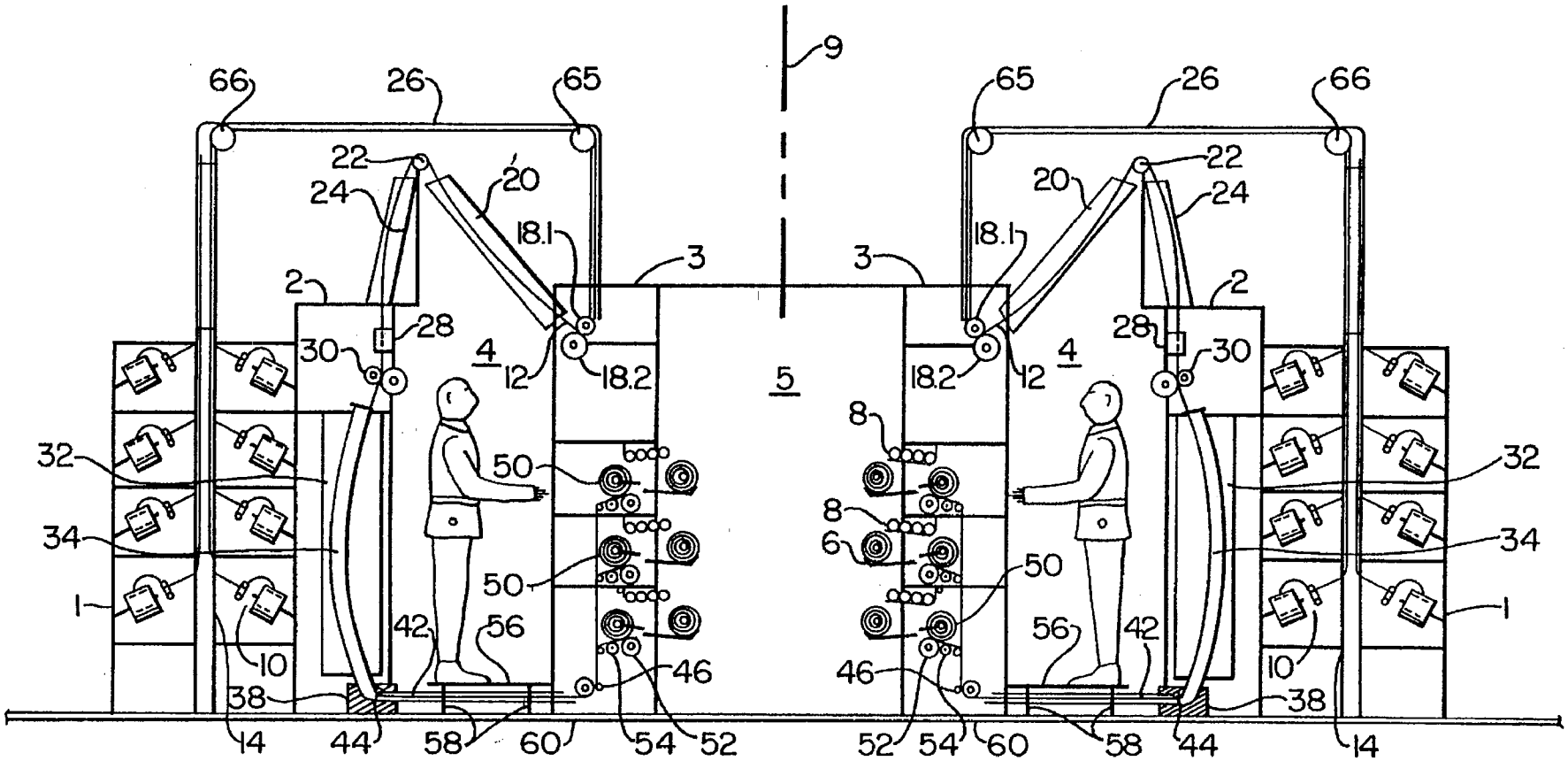

Referring to FIG. 3, the frame members, namely creel 1, processing frame 2, and take-up frame 3, are arranged with respect to each other, and the yarn is guided such that it advances between the creel and first feed system 18 above heater 20 and cooling plate 24 without contacting same.

To this end, a bundle of tubes 26 is used, in which all yarns of the processing stations advance to be wound on three superposed take-up devices 7. The individual tubes of this bundle of tubes include an upwardly directed leg, a horizontal leg, and a downwardly directed leg. The tubes are airtight, so that the yarns can be sucked off and sucked in by means of a suction gun, which is held against the individual tube in the region of first feed system 18. This tubular passageway has the advantage that it does not obstruct the operation of heater 20 and cooling plate 24 and the threading of the yarn. On the other hand, the bundle of tubes is simple to operate in that it permits the yarn to be sucked therethrough. The tubes possess the gentlest possible deflections, so as to permit the yarn to advance without being damaged, and so that air is prevented from accumulating.

In the embodiment of FIG. 3, the yarn is deflected at bends 66 and 65 respectively by 90°, namely at bend 66 so as to advance from the vertical to the horizontal, and at bend 65 so as to advance from the horizontal to the vertical. The yarn can then advance directly to feed shaft 18.1. Pressure roll 18.2 is freely accessible to the operator, and can easily be moved in the radial direction. In particular, it is not necessary or desirable to provide an additional yarn deflection as in the embodiment of FIGS. 1 and 1A.

It should however be expressly indicated that it is also possible to use the embodiment of FIG. 1, in which the yarn advances directly to the first feed system 18, when the feed shaft is arranged such that it faces the operator. In this instance, there results only a certain complication in the operation of the pressure roll, which may however be made up for by a corresponding construction of the pressure roll.

In the embodiments of FIGS. 1–3, it is necessary to fan out the threadlines above the operator aisle in a horizontal plane in such a manner that their threadlines previously bundled in the creel separate, and each yarn advances to a respective one of the feed systems 18 or the feed zones of the feed shaft. The embodiment of FIG. 3 also permits the yarns to fan out only in the vertical plane between deflection 65 and first feed system 18.

Referring to FIGS. 4 and 5, 7 and 8, the creels, processing frames and take-up frames 3 are so arranged, and each yarn advances such that it is guided from deflection 66 on creel 1 of, for example, the left-hand machine half, not to the feed system of the same machine half, but through mirror plane 9, to feed system 18 of the other, right-hand machine half, and that it is then treated, false twist crimped, and wound in the frame members, such as take-up frame 3 and processing frame 2, of the other, right-hand machine half. Likewise to this end, each yarn is guided in its own tube. In creel 1, the tubes of several yarns are combined to a bundle 26. Each tube is airtight, so as to permit each yarn to be sucked therethrough by means of a suction gun, which is held against the tubular passageway in the region of first feed system 18. This tubular passageway has the advantage that it does not obstruct the operation of heater 20 and cooling plate 24 and the threading of the yarn. On the other hand, it is easy to operate the tube or tubes as a result of being able to suck in the yarns. The tubes 26 possess the gentlest possible bends, so as to permit the yarn to advance without being damaged, and so as to prevent air from accumulating.

Referring in particular to the embodiment of FIG. 4, its characteristic consists in that the yarns advancing from the left-hand machine half are processed in the right-hand machine half, or vice versa. This allows to simplify the entry into first feed system 18, and to reduce the sum of the deflection angles upstream of first feed system 18.

The bundle of tubes proceeding from the creel extends above the creel and above heater 20 or cooling plate 24 as a result of deflection device 66 in a horizontal plane 63 in direction toward mirror plane 9. At deflection 65, the tubes are directed downward. The deflection 65 may be located anywhere along a horizontal line in that space, which extends above heater 20 of the left-hand machine half and first feed system 18 of the right-hand machine half. Preferably, the deflection 65 is located on the side of mirror plane 9, on which also creel 1 is arranged, from which the tubular passageway originates. No later than between deflection 65 and first feed systems 18 of the right-hand machine half is the bundle of tubes 26 fanned out such that one tube terminates in front of each feed zone of feed shaft 18.1. This applies likewise to the yarns advancing from the creel arranged on the right side of mirror plane 9.

Figure 5:
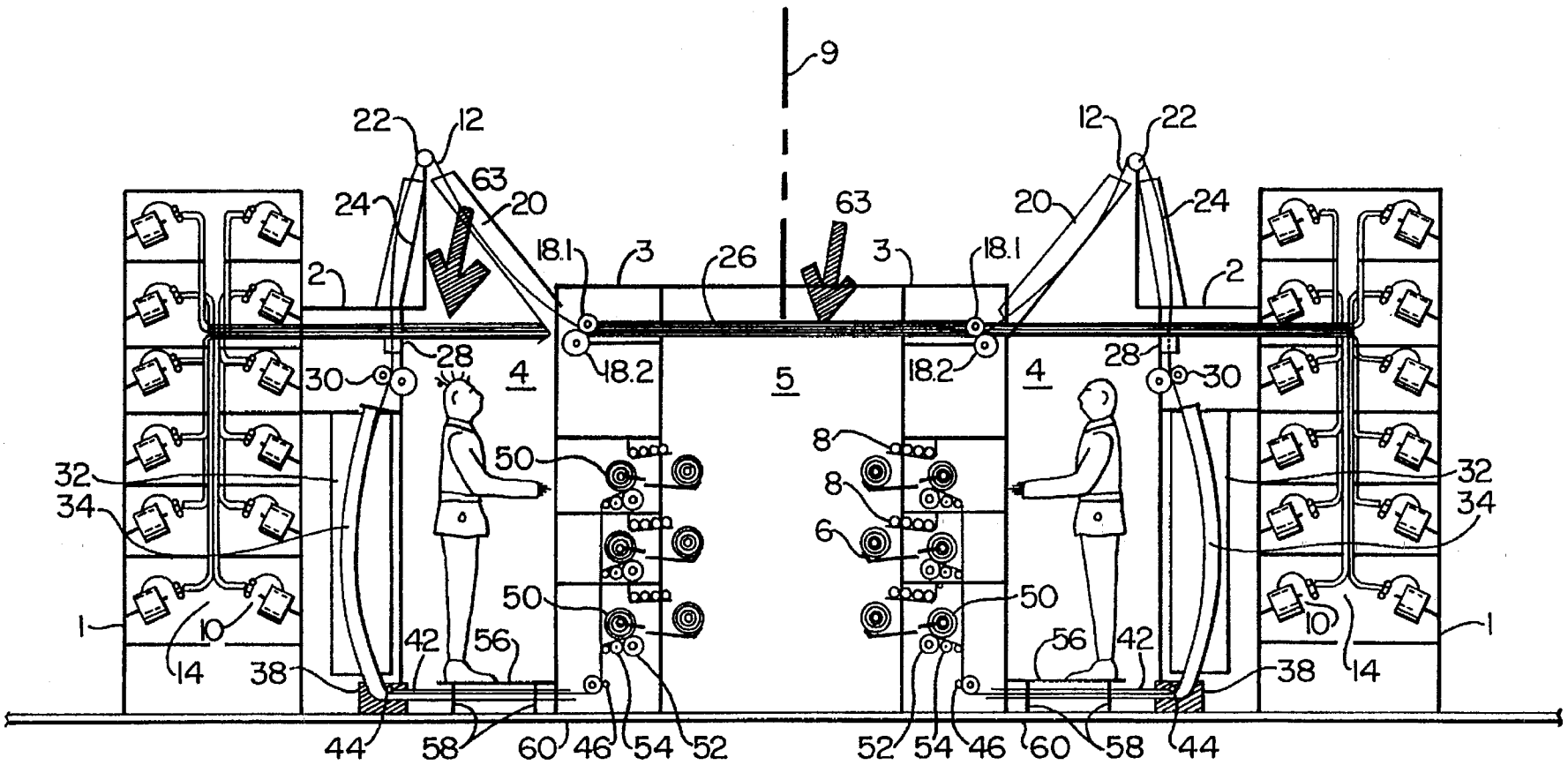
Figure 6:
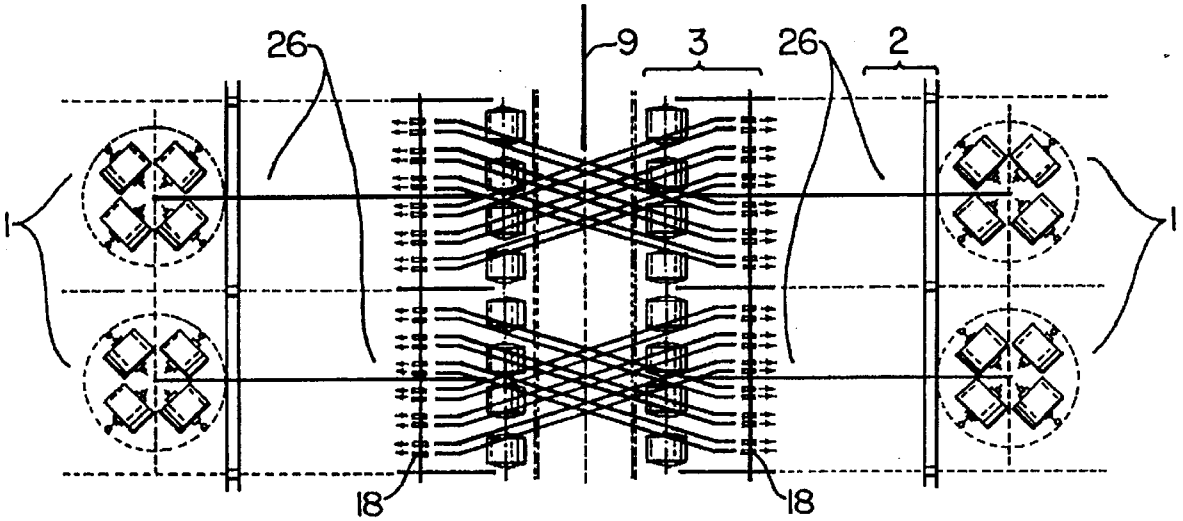
FIG. 6 is a top view of the false twist crimping apparatus with threadlines in accordance with FIGS. 4, 5, and 7.
Figure 7:
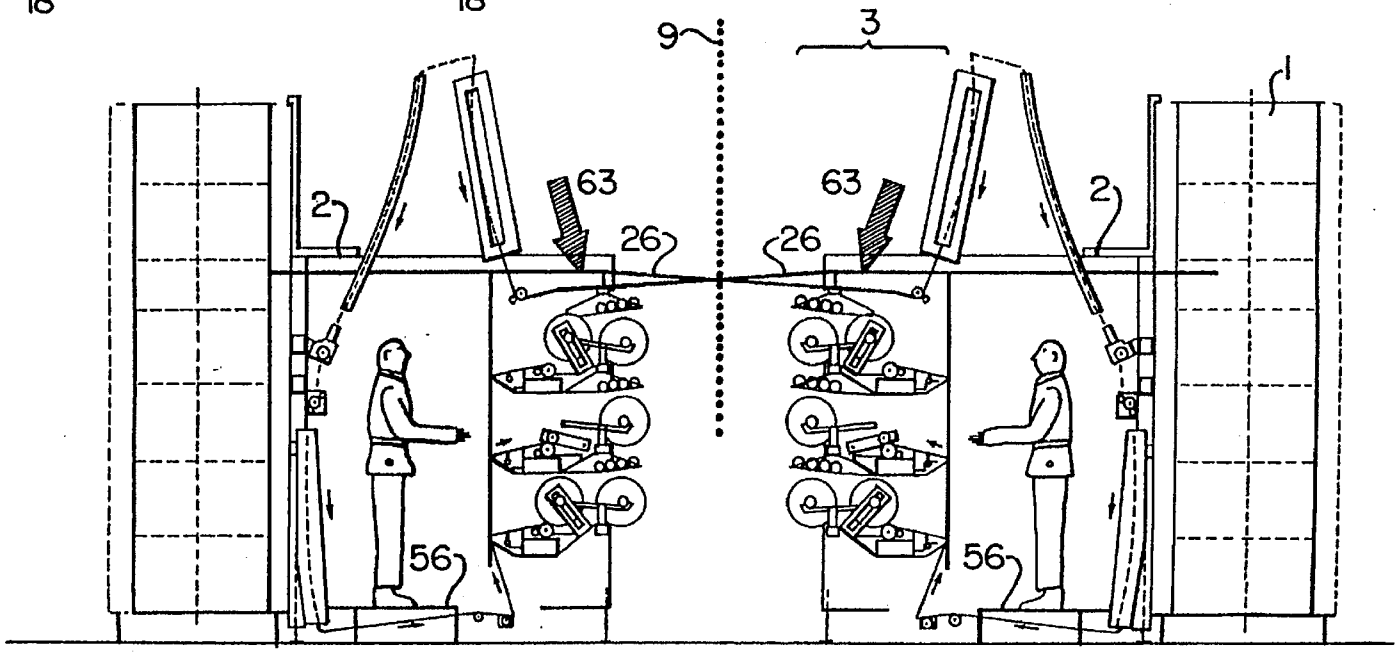
Figure 8:
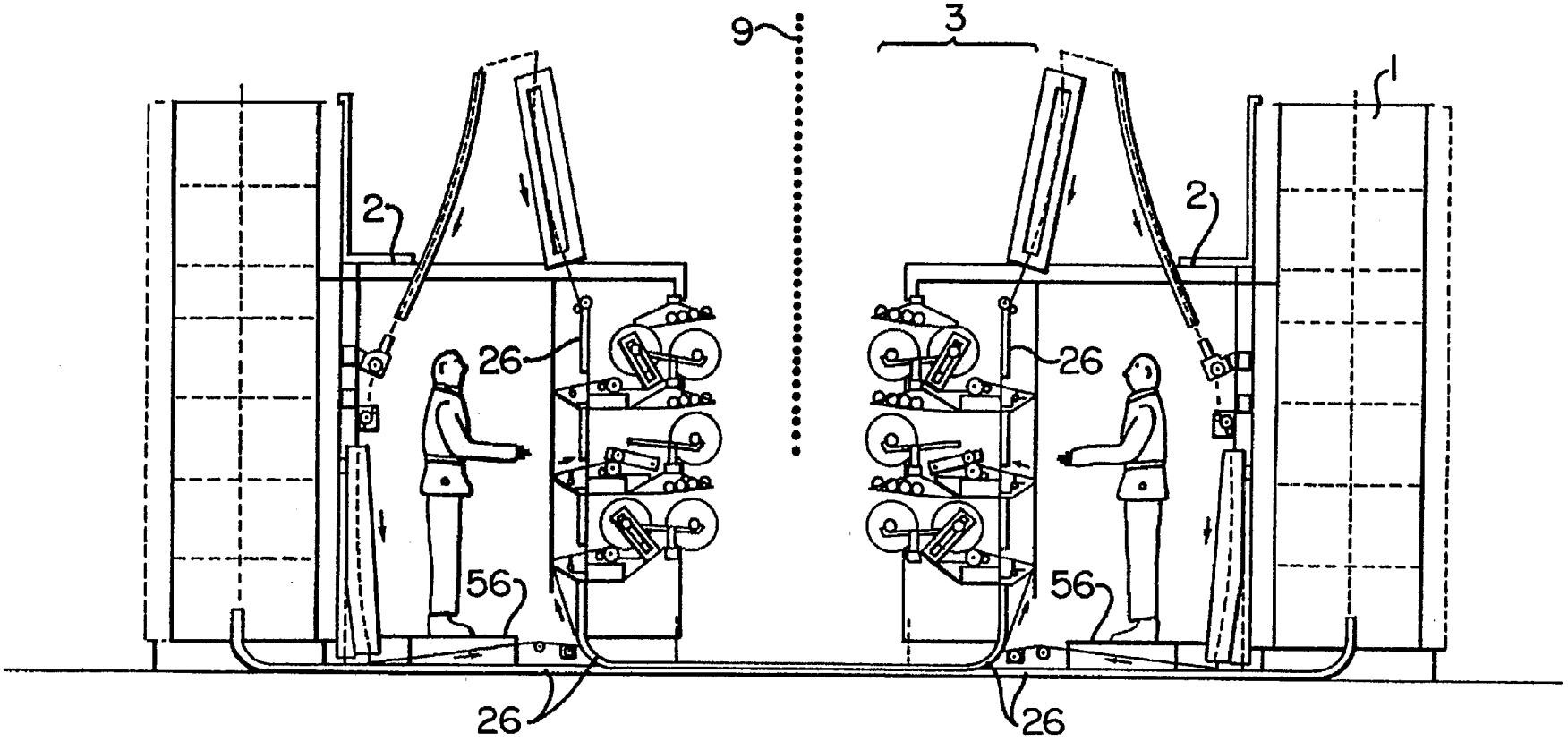

Referring to FIGS. 5 and 7, the embodiments shown therein employ, for example, a particularly tall creel 1. Directly downstream of their feed packages, each yarn is pulled into a tube. FIG. 5 shows the tubes, which proceed from the feed yarn packages creeled in the lower portion of the creel and extend upward. The tubes which proceed from the feed yarn packages creeled in the upper portion of the creel, extend downward. All tubes are combined to a bundle and extend then along a horizontal (FIG. 5) or an inclined (FIG. 7) guide plane 63. This plane 63 lies above the head of the operating personnel and in such a manner that the feed systems and treatment devices of the texturing zones are the least possible affected. In the embodiment of FIG. 7, the planes 63 of the two machine halves are oppositely inclined. FIG. 6 is a top view of these planes 63 related in particular to FIGS. 5 and 7. More specifically, the tubes extend in bundles in a direction toward the respective other machine half. Shortly before or behind mirror plane 9, the bundle of tubes is fanned out, so that each tube terminates in front of one feed zone of feed shaft 18.1. It is important that the tubes are not fanned out in front of feed system 18 of that machine half, from which the bundle of tubes 26 originates. Again, it is emphasized that the yarns advancing from the creel arranged on the right side of mirror plane 9, are guided through mirror plane 9 to feed system 18 of the left-hand machine half, and treated, false twist crimped and wound therein. The same applies to the yarns advancing from the creel arranged on the left side of the mirror plane. It should be remarked, that tubular passageway 26 of the yarns advancing from the left in FIG. 5 is discontinued for reasons of a better illustration. It may be useful to have planes 63 of the group of yarns advancing from the right side and of that advancing from the left side extend at different heights, or, as shown in FIG. 7, to have the planes 63 oppositely inclined, so that the yarns have a downwardly directed component. This makes it geometrically easier to fan out the guide tubes.

Referring now to FIG. 8, the bundle 26 of guide tubes combined in creel frame 1 extends downward to a plane of the machine, which extends below platform 56. There, the bundle is deflected to a horizontal direction. Then, the bundle passes below the platform. Downstream of the platform, the bundle is fanned out to proceed to the other machine half. There, the tubes pass below platform 56 of the other machine half. Below the take-up frame of the other machine half, the tubes are deflected upward and proceed upward in a vertically directed plane. Finally, each tube terminates in front of one of feed systems 18.

FIG. 6 applies in particular to FIGS. 5 and 7. However, the embodiment may also be applied to FIGS. 4 and 8, and is therefore described again in more detail.

Illustrated in FIG. 6 is the described tubular passageway in a top view of the machine, there being shown only a section of the overall length of the machine. To be able to clearly illustrate the tubular passageway, essential parts of the processing frame and take-up frame have been omitted. Shown are creel frames 1 which are circular. Arranged on each horizontal plane are four packages. Several of such planes overlie one another, as has been shown in the other embodiments. Each yarn is pulled into a vertically upward or vertically downward extending tube. The tubes proceeding from the creel are combined to a bundle 26. From creel frame 1, the bundle of tubes extends in a horizontal (FIG. 5) or in a downward inclined guide plane 63. At first, the bundle of tubes 26 traverses processing frame 2, then operator aisle 4, and thereafter take-up frame 3 of that machine half, from which it originates. Approximately above (FIGS. 5 and 7) or below (FIG. 8) take-up frame 3, the bundle 26 of tubes is fanned out in plane 63. In this fanned-out formation, each guide tube extends such that it terminates in front of one of feed systems 18 in take-up frame 3 of respectively the other machine half. In front of this feed system 18, which is the first feed system for the entire texturing process, it is possible to also arrange a yarn cutter 67. As shown in FIG. 6, the guide tubes of the one machine half intersect the guide tubes of the other machine half in their fanned-out configuration. This is easily possible, when the tubes, as in FIG. 7, extend along inclined guide planes 63. When, as shown in FIGS. 5 and 8, the tubes extend horizontally, they are laid in parallel planes 63, which can closely adjoin one another. The path, along which the yarn continues to be advanced, is not shown in FIG. 6, since therein the machine components arranged above plane 63 have been omitted for a better illustration. It should here be mentioned that FIG. 6 may likewise be applied to the arrangement of FIG. 4 with the one difference that, in this instance, the bundle of tubes 26 extends at first substantially horizontally to deflection 65. From this deflection 65, the bundle of tubes is fanned out, with the plane of the fanned-out configuration being inclined downward. Conversely, in the embodiment of FIG. 8, the bundle proceeds initially from the creel in horizontal direction, and may be fanned out already along this horizontal path. Thereafter, it is necessary to have the tubes proceeding from the one machine half extend in a different plane than the tubes proceeding from the other machine half. This is avoided, when the bundle of tubes is fanned out only after having been deflected to the vertical plane.

In the drawings and specifications, there has been set forth a preferred embodiment of the invention, and although specific terms are employed, they are used in a generic and descriptive sense only and not for purposes of limitation.

That which is claimed:

1. A yarn false twist crimping apparatus comprising a processing frame (2), a creel (1) for supporting at least one yarn package and positioned adjacent said processing frame, a take-up frame (3) laterally spaced from said processing frame (2) so as to define an operator aisle (4) therebetween, and so as to also define a service aisle (5) on the side of said take-up frame opposite said processing frame, false twist imparting means for imparting false twist to an advancing yarn and comprising a first yarn feed system (18), an elongate first heater (20), an elongate cooling plate (24), a false twist unit (28), a second yarn feed system (30), and a yarn take-up device (7), wherein said first yarn feed system is mounted on said take-up frame, said false twist unit and said second yarn feed system are mounted on said processing frame, and said first heater and said cooling plate are mounted so as to define a yarn path extending across said operator aisle and from the take-up frame to the processing frame, wherein said take-up device is positioned so as to be serviceable both from said operator aisle and from said service aisle, and wherein said creel is positioned on one side of said processing frame and said take-up frame is positioned on the other side of said processing frame.

2. The yarn false twist crimping apparatus as defined in claim 1 wherein said false twist imparting means further comprises a second heater (34) mounted on said processing frame, and a third yarn feed system (46).

3. The yarn false twist crimping apparatus as defined in claim 2 wherein said third yarn feed system is mounted on said take-up frame below said yarn take-up device.

4. The yarn false twist crimping apparatus as defined in claim 1 wherein said false twist imparting means further comprises a heating tube (34) mounted on said processing frame in a generally upright orientation and below said false twist unit and said second yarn feed system.

5. The yarn false twist crimping apparatus as defined in claim 4 wherein said false twist imparting means further comprises a non-heated transport tube (42) connected to the downstream end of said heating tube and extending in a generally horizontal direction laterally across said operator aisle and to said take-up frame, and a third yarn feed system (46) mounted on said take-up frame.

6. The yarn false twist crimping apparatus as defined in claim 5 wherein said elongate first heater and said elongate cooling plate are positioned above said operator aisle and so as to assume the configuration of an inverted V.

7. The yarn false twist crimping apparatus as defined in claim 6 wherein said processing frame, said creel, and said take-up frame are all positioned on a supporting floor (60), and wherein said transport tube is positioned immediately adjacent said floor.

8. The yarn false twist crimping apparatus as defined in claim 7 further comprising an operator walkway (56) positioned in said operator aisle immediately above said transport tube.

9. The yarn false twist crimping apparatus as defined in claim 8 further comprising a connecting member (38) interconnecting said heating tube and said transport tube in a right angled relationship.

10. The yarn false twist crimping apparatus as defined in claim 1 wherein said yarn take-up device is mounted on said take-up frame, and further comprising a third yarn feed system (46) which is mounted on said take-up frame.

11. The yarn false twist crimping apparatus as defined in claim 1 wherein said first heater and said take-up device are mounted to said take-up frame, and said cooling plate is mounted to said processing frame.

12. A yarn false twist crimping apparatus comprising a processing frame (2), a creel (1) positioned on one side of said processing frame for supporting a plurality of yarn packages, a take-up frame (3) positioned on the other side of said processing frame and laterally spaced therefrom so as to define an operator aisle (4) therebetween, and so as to also define a service aisle (5) on the side of said take-up frame opposite said processing frame, a plurality of side by side false twist imparting units for imparting false twist to each of a plurality of advancing yarns, with each of said false twist imparting units comprising a first yarn feed system (18), an elongate first heater (20), an elongate cooling plate (24), a false twist unit (28), a second yarn feed system (30), and a yarn take-up device (7), and wherein said first yarn feed systems, said first heaters, and said take-up devices are all mounted on said take-up frame; said cooling plates, said false twist units, and said second yarn feed systems are all mounted on said processing frame; and wherein said take-up devices are each positioned so as to be serviceable both from said operator aisle and from said service aisle.

13. The yarn false twist crimping apparatus as defined in claim 12 wherein said take-up devices are mounted in a plurality of vertical columns on said take-up frame, and wherein said elongate first heater and said elongate cooling plate are positioned above said operator aisle and so as to assume the configuration of an inverted V.

14. The yarn false twist crimping apparatus as defined in claim 13 further comprising guide roll means (16) for guiding the yarns from said creel in a generally planar arrangement across the operator aisle and then to respective ones of the first yarn feed system, and such that the yarns then advance through respective ones of the elongate first heater, elongate cooling plate, false twist unit, and second yarn feed system and intersect the plane defined by said generally planar arrangement.

15. A yarn false twist crimping apparatus comprising first and second machine halves, with each of said halves comprising (a) a processing frame (2), (b) a creel (1) positioned on one side of said processing frame for supporting a plurality of yarn packages, (c) a take-up frame (3) positioned on the other side of said processing frame and laterally spaced therefrom so as to define an operator aisle (4) therebetween, (d) a plurality of side by side false twist imparting units for imparting false twist to each of a plurality of advancing yarns, with each of said false twist imparting units comprising a first yarn feed system (18), an elongate first heater (20), an elongate cooling plate (24), a false twist unit (28), a second yarn feed system (30), and a yarn take-up device (7), and wherein said first yarn feed systems and said take-up devices are all mounted on said take-up frame; said false twist units, and said second yarn feed systems are all mounted on said processing frame and said first heaters and said cooling plates are mounted so as to extend across said operator aisle, said first and second machine halves being arranged in mirror symmetry on opposite sides of a vertical plane (9) and so as to define a service aisle (5) between said take-up frames of said first and second machine halves.

16. The yarn false twist crimping apparatus as defined in claim 15 further comprising guide means (26, 65, 66) for guiding a plurality of yarns from each of said creels across said service aisle and to respective ones of the first yarn feed systems of the other machine half.

17. The yarn false twist crimping apparatus of claim 16 wherein said guide means includes a plurality of first tubes (26) each for supporting a plurality of yarns as a bundle, and a plurality of second tube segments which extend from the downstream end of respective first tubes and fan out in the direction of the length of the machine.

18. The yarn false twist crimping apparatus of claim 17 wherein said first tubes extend above the elongate first heater and the elongate cooling plate of the associated machine half.

19. The yarn false twist crimping apparatus of claim 18 wherein said second tube segments are inclined downwardly from said first tubes to the first yarn feed systems of the other machine half.

20. The yarn false twist crimping apparatus of claim 17 wherein said first tubes extend through the processing frame and the operator aisle of the associated machine half substantially above head height of the operator, and the second tube segments are substantially co-planar with the associated first tubes to define a guide plane (63).

21. The yarn false twist crimping apparatus of claim 20 wherein said guide planes of the two machine halves are oppositely and downwardly inclined.

22. The yarn false twist crimping apparatus of claim 17 wherein said first and second machine halves are supported on a horizontal floor, said first tubes extend at an elevation immediately adjacent the floor to the other machine half, and said second tube segments extend in a substantially vertical plane in said creel of said other machine half.

23. The yarn false twist crimping apparatus as defined in claim 16 wherein said guide means is configured to guide the yarns along a path which is above said service aisle.

24. The yarn false twist crimping apparatus as defined in claim 16 wherein said guide means is configured to guide the yarns along a path which is below said service aisle.

25. The yarn false twist crimping apparatus of claim 15 wherein said take-up frame of each of said machine halves mounts the associated take-up devices in a plurality of vertical columns, and a package storage device is mounted adjacent each of said take-up devices so as to be serviceable from said service aisle.

26. A yarn false twist crimping apparatus comprising a processing frame (2), a creel (1) for supporting at least one yarn package and positioned adjacent said processing frame, a take-up frame (3) laterally spaced from said processing frame (2) so as to define an operator aisle (4) therebetween, and so as to also define a service aisle (5) on the side of said take-up frame opposite said processing frame, false twist imparting means for imparting false twist to an advancing yarn and comprising a first yarn feed system (18), an elongate first heater (20), an elongate cooling plate (24), a false twist unit (28), a second yarn feed system (30), and a yarn take-up device (7), and wherein said first yarn feed system is mounted on said take-up frame, said false twist unit and said second yarn feed system are mounted on said processing frame, and said first heater and said cooling plate are mounted so as to define a yarn path extending across said operator aisle and from the take-up frame to the processing frame, wherein said take-up device is positioned so as to be serviceable both from said operator aisle and from said service aisle, and wherein said false twist imparting means further comprises a second heater (34) mounted on said processing frame, and a third yarn feed system (46).

27. The yarn false twist crimping apparatus as defined in claim 26 wherein said third yarn feed system is mounted on said take-up frame below said yarn take-up device.

28. A yarn false twist crimping apparatus comprising a processing frame (2), a creel (1) for supporting at least one yarn package and positioned adjacent said processing frame, a take-up frame (3) laterally spaced from said processing frame (2) so as to define an operator aisle (4) therebetween, and so as to also define a service aisle (5) on the side of said take-up frame opposite said processing frame, false twist imparting means for imparting false twist to an advancing yarn and comprising a first yarn feed system (18), an elongate first heater (20), an elongate cooling plate (24), a false twist unit (28), a second yarn feed system (30), and a yarn take-up device (7), and wherein said first yarn feed system is mounted on said take-up frame, said false twist unit and said second yarn feed system are mounted on said processing frame, and said first heater and said cooling plate are mounted so as to define a yarn path extending across said operator aisle and from the take-up frame to the processing frame, wherein said take-up device is positioned so as to be serviceable both from said operator aisle and from said service aisle, and wherein said false twist imparting means further comprises a heating tube (34) mounted on said processing frame in a generally upright orientation and below said false twist unit and said second yarn feed system.

29. The yarn false twist crimping apparatus as defined in claim 28 wherein said false twist imparting means further comprises a non-heated transport tube (42) connected to the downstream end of said heating tube and extending in a generally horizontal direction laterally across said operator aisle and to said take-up frame, and a third yarn feed system (46) mounted on said take-up frame.

30. The yarn false twist crimping apparatus as defined in claim 29 wherein said elongate first heater and said elongate cooling plate are positioned above said operator aisle and so as to assume the configuration of an inverted V.

31. The yarn false twist crimping apparatus as defined in claim 30 wherein said processing frame, said creel, and said take-up frame are all positioned on a supporting floor (60), and wherein said transport tube is positioned immediately adjacent said floor.

32. The yarn false twist crimping apparatus as defined in claim 31 further comprising an operator walkway (56) positioned in said operator aisle immediately above said transport tube.

33. The yarn false twist crimping apparatus as defined in claim 32 further comprising a connecting member (38) interconnecting said heating tube and said transport tube in a right angled relationship.

* * * * *